US012497259B2

(12) United States Patent
Sanada

(10) Patent No.: US 12,497,259 B2
(45) **Date of Patent: *Dec. 16, 2025**

(54) REGULATION DEVICE AND PRINTER

(71) Applicant: TOSHIBA TEC KABUSHIKI KAISHA, Tokyo (JP)

(72) Inventor: Tsuyoshi Sanada, Susono Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 300 days.

This patent is subject to a terminal disclaimer.

(21) Appl. No.: 18/174,671

(22) Filed: Feb. 27, 2023

(65) Prior Publication Data

US 2024/0286858 A1 Aug. 29, 2024

(51) Int. Cl.
*B65H 23/032* (2006.01)
*B65H 16/02* (2006.01)

(52) U.S. Cl.
CPC ..... *B65H 23/0326* (2013.01); *B65H 16/02* (2013.01); *B65H 2402/442* (2013.01); *B65H 2402/60* (2013.01); *B65H 2403/411* (2013.01); *B65H 2801/03* (2013.01); *B65H 2801/12* (2013.01)

(58) Field of Classification Search
CPC ..... B65H 23/0326; B65H 2402/442; B65H 2403/41; B65H 2403/411; B65H 2403/412
See application file for complete search history.

(56) References Cited

U.S. PATENT DOCUMENTS

| | | | | |
|---|---|---|---|---|
| 9,290,026 | B2 * | 3/2016 | Nagashima | B41J 15/042 |
| 12,240,227 | B2 * | 3/2025 | Sanada | B41J 11/0045 |
| 2013/0049290 | A1 | 2/2013 | Matsumoto | |

* cited by examiner

*Primary Examiner* — Jeremy R Severson
(74) *Attorney, Agent, or Firm* — Amin, Turocy & Watson, LLP

(57) ABSTRACT

A regulation device regulates movement in a width direction of a rolled sheet which is a recording medium of a printer. The regulation device includes: a first rack gear connected to one guide support unit supporting the rolled sheet so that movement to one side of the width direction is regulated, and provided to be movable in the width direction; a second rack gear connected to the other guide support unit supporting the rolled sheet so that movement to the other side of the width direction is regulated, and provided to be movable in the width direction; a pinion gear engaging with the first and second rack gears; and a regulation gear that engages with the first rack gear to rotate and regulates the movement of the first and second rack gears by regulating the rotation.

20 Claims, 4 Drawing Sheets

REGULATION DEVICE AND PRINTER

FIELD

Embodiments described herein relate generally to a technology for regulating movement of a recording medium of a printer.

BACKGROUND

In the related art, a rolled sheet in which a long sheet is wound around the outer circumference of a core formed in a substantially cylindrical shape is used as a recording medium of a printer. The printer using the rolled sheet includes two guide support units provided to be movable in a width direction of the rolled sheet. The core of the rolled sheet is supported by the two guide support units so that movement in the width direction is regulated. The two guide support units are configured to move in the width direction in conjunction with each other. Accordingly, the rolled sheet is set in the printer so that a substantially middle portion of the rolled sheet in the width direction is located at a position in a predetermined width of the printer.

If the rolled sheet is set in the printer, a user first moves the two guide support units to be separated from each other, and mounts the rolled sheet between the two guide support units. Thereafter, the user moves the two guide support units to be close to each other in accordance with the width of the rolled sheet.

DETAILED DESCRIPTION

Figure 1:
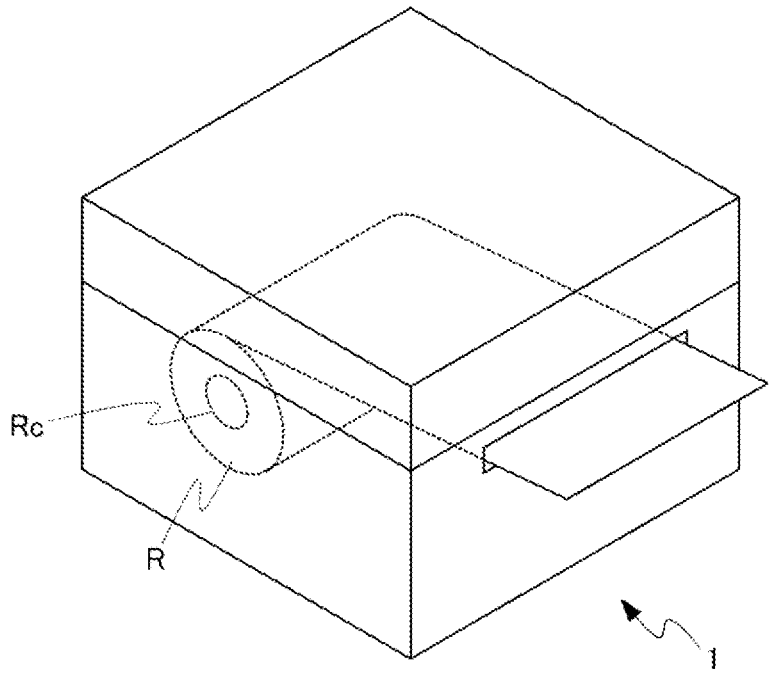
FIG. 1 is a schematic perspective view illustrating a configuration of a printer according to a first embodiment.

An aspect of an exemplary embodiment provides a technology capable of setting a rolled sheet in a printer more easily.

Hereinafter, embodiments will be described with reference to the drawings. In each drawing, the same reference numerals are given to the same configurations.

First Embodiment

Configuration of Printer and Guide Device

Figure 2:
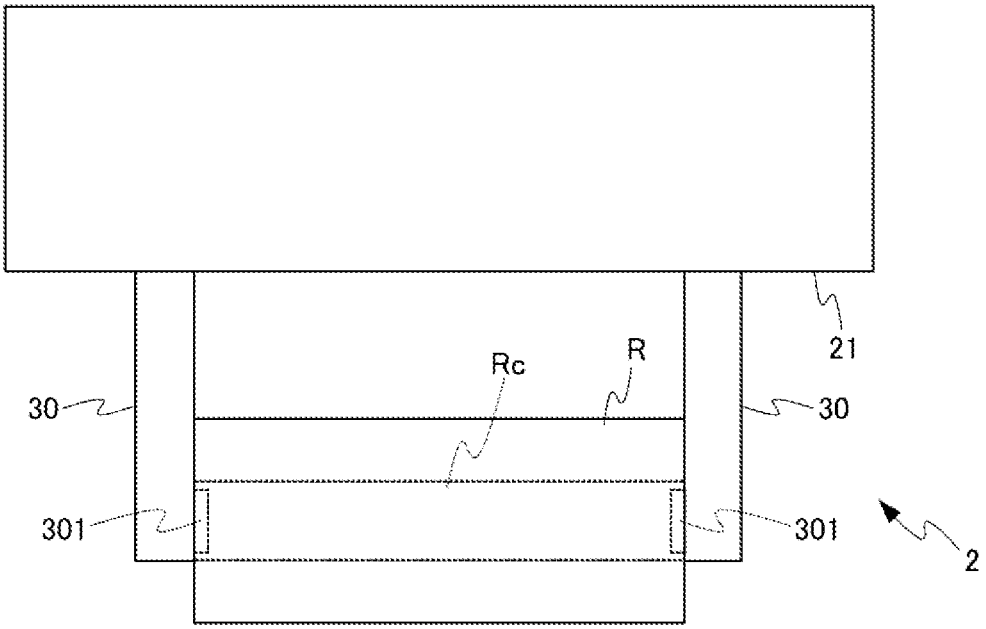
FIG. 2 is a schematic plan view illustrating a configuration of a guide device.

Configurations of a printer and a guide device according to a first embodiment will be described. FIG. 1 is a schematic perspective view illustrating the configuration of the printer according to the present embodiment. FIG. 2 is a schematic plan view illustrating the configuration of the guide device according to the present embodiment.

As illustrated in FIG. 1, a printer 1 is an apparatus that forms an image on a rolled sheet R which is a recording medium. The printer 1 defines an accommodation space where the rolled sheet R can be accommodated inside and is configured to be openable and closable so that the rolled sheet R can be set in the accommodation space from the outside. The rolled sheet R is a long printing sheet wound around a core Rc formed in a substantially cylindrical shape. The printer 1 forms an image on the rolled sheet R and ejects the image to the outside while winding and unwinding the rolled sheet R.

As illustrated in FIG. 2, a guide device 2 includes a regulation device 21 and two guide support units 30 and rotatably supports the rolled sheet R while regulating movement in a width direction of the rolled sheet R. Each of the two guide support units 30 is a long substantial plate member extending in one direction and a support portion 301 is provided on one surface side at one end. The support portion 301 is formed in a substantially discoid shape which can be inserted into the core Rc. In the two guide support units 30, the other ends are connected to the regulation device 21 so that the support portions 301 face each other.

The regulation device 21 supports the two guide support units 30 so that the guide support units 30 can move only in an orthogonal direction orthogonal to extension directions of the guide support units 30 and regulates movement of the two guide support units 30 inward in the orthogonal direction in accordance with a set width set by a user, as will be described in detail below.

Configuration of Regulation Device

Figure 3:
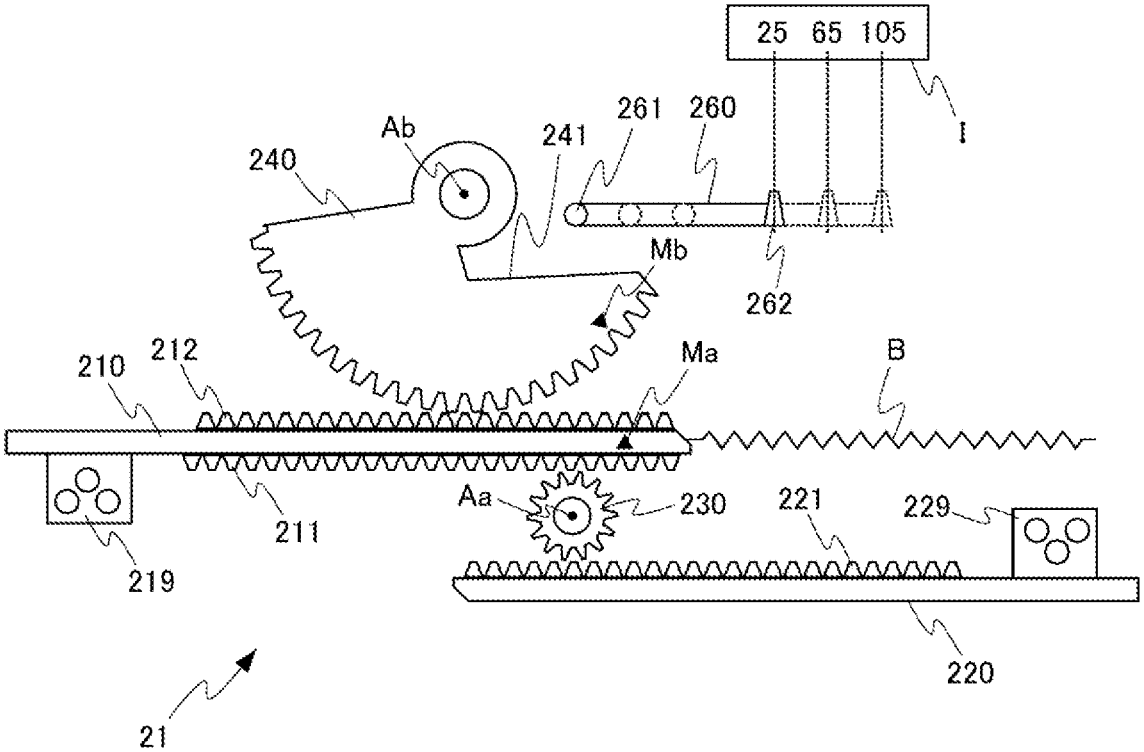
FIG. 3 is a schematic plan view illustrating a configuration of a regulation device.

A configuration of a regulation device according to the first embodiment will be described. FIG. 3 is a schematic plan view illustrating the configuration of the regulation device according to the present embodiment.

As illustrated in FIG. 3, the regulation device 21 includes a first rack gear 210, a second rack gear 220, a pinion gear 230, a regulation gear 240, and a rotation regulation portion 260.

The first rack gear 210 is formed in a substantial plate shape on the whole and includes a first gear portion 211, a second gear portion 212, and a connection portion 219. The first gear portion 211 is formed on one surface of the first rack gear 210 and includes a plurality of teeth juxtaposed in an extension direction of the first rack gear 210. The second gear portion 212 is formed on the other surface of the first rack gear 210 and includes a plurality of teeth juxtaposed in an extension direction of the first rack gear 210.

The connection portion 219 is formed at one end of the first rack gear 210 and connected to an end on a side on which a support portion 301 of one guide support unit 30 is not provided. The one guide support unit 30 is connected to the connection portion 219 so that the extension direction of the one guide support unit 30 is orthogonal to the extension direction of the first rack gear 210 and the support portion 301 faces the other end side of the first rack gear 210.

The second rack gear 220 is formed in a substantial plate shape on the whole and includes a first gear portion 221 and a connection portion 229. The first gear portion 221 is formed on one surface of the second rack gear 220 and includes a plurality of teeth juxtaposed in an extension direction of the second rack gear 220.

The connection portion 229 is formed at one end of the second rack gear 220 and connected to an end on a side on which a support portion 301 of the other guide support unit 30 is not provided. The other guide support unit 30 is connected to the connection portion 229 so that the extension direction of the other guide support unit 30 is orthogonal to the extension direction of the second rack gear 220 and the support portion 301 faces the other end side of the second rack gear 220.

The pinion gear 230 is a circular gear rotating about a rotation shaft Aa and engages with the first gear portion 211 of the first rack gear 210 and the first gear portion 221 of the second rack gear 220.

The first rack gear 210 and the second rack gear 220 are disposed so that the extension directions of the first rack gear 210 and the second rack gear 220 are orthogonal to an axial direction of the rotation shaft Aa. The first rack gear 210 and the second rack gear 220 are disposed so that the first gear portion 211 and the first gear portion 221 face each other in a direction orthogonal to the extension directions of the first rack gear 210 and the second rack gear 220 and the axial direction of the rotation shaft Aa.

In the following description, the extension directions of the first rack gear 210 and the second rack gear 220 are referred to as a horizontal direction, the axial direction of the rotation shaft Aa is referred to as a vertical direction, and a direction orthogonal to the horizontal direction and the vertical direction is referred to as an anteroposterior direction. In the present embodiment, two guide support units 30 are connected to the first rack gear 210 and the second rack gear 220 so that the extension directions of the guide support units 30 are oriented in the anteroposterior direction (a direction oriented vertically in FIG. 3).

The first rack gear 210 and the second rack gear 220 are disposed so that the connection portions 219 and 229 are located outward in the horizontal direction, respectively. In the first rack gear 210, an urging member B is connected to an end on the side opposite to the end at which the connection portion 219 is provided. The urging member B is a member that urges the first rack gear 210 inward in the horizontal direction and is configured as a tension coil spring in the present embodiment.

The regulation gear 240 is a variant circular gear that rotates about a rotation shaft Ab of which an axial direction is oriented in the same direction as the rotation shaft Aa, that is, the vertical direction, and is formed in a substantial fan shape that has an arc forming a part of the circumference of a circle centered on the rotation shaft Ab. A plurality of teeth engaging with the second gear portion 212 of the first rack gear 210 are formed in the arc of the regulation gear 240. The regulation gear 240 engages with the second gear portion 212 over at least the entire movement range of the first rack gear 210. Accordingly, the length of the arc of the regulation gear 240 can be shortened in accordance with a maximum movement amount of the first rack gear 210. In the regulation gear 240, a locked surface 241 which is a surface intersecting in a rotation direction of the regulation gear 240 is formed. In the present embodiment, the locked surface 241 is formed on one side of two edges extending toward the vicinity of the rotation shaft Ab from the end in the circumferential direction of the arc.

The rotation regulation portion 260 is a long member in which a locking portion 261 is formed at one end and a manipulation portion 262 is formed at the other end. The rotation regulation portion 260 is provided so that the locking portion 261 can move in a direction orthogonal to the rotation direction of the regulation gear 240 and the axial direction of the rotation shaft Ab and, preferably, in a radial direction of the pitch circle of the regulation gear 240. The locking portion 261 moves so that the locking portion 261 enters a range in which the locking portion 261 comes into contact with the locked surface 241 if the regulation gear 240 is rotated to the side on which the locked surface 241 is formed (a counterclockwise direction in FIG. 3).

The manipulation portion 262 is provided to be exposed to the outside of the printer 1 and to be able to be held by the user. In the printer 1, an indicator I indicating a plurality of widths of the rolled sheet R is provided and the plurality of widths are juxtaposed in the movement direction of the rotation regulation portion 260. The indicator I is provided in the printer 1 so that the manipulation portion 262 indicates the plurality of widths. The user moves the rotation regulation portion 260 through the manipulation portion 262 in accordance with the width of the rolled sheet R set in the printer 1. In the rotation regulation portion 260, a latch mechanism (not illustrated) that regulates movement of the rotation regulation portion 260 is provided. The user releases regulation by the latch mechanism through the manipulation portion 262 if the rotation regulation portion 260 is moved. Display positions of the plurality of widths included in the indicator I are set to match a distance between the two guide support units 30.

In each of the first rack gear 210 and the regulation gear 240, markers Ma and Mb are engraved, respectively. A worker who manufactures the regulation device 21 assembles the regulation gear 240 to the first rack gear 210 so that the marker MA of the first rack gear 210 matches the marker Mb of the regulation gear 240. Accordingly, it is possible to reduce variation in regulation positions of the two guide support units 30 for each regulation device 21.

Operation of Regulation Device

Figure 4:
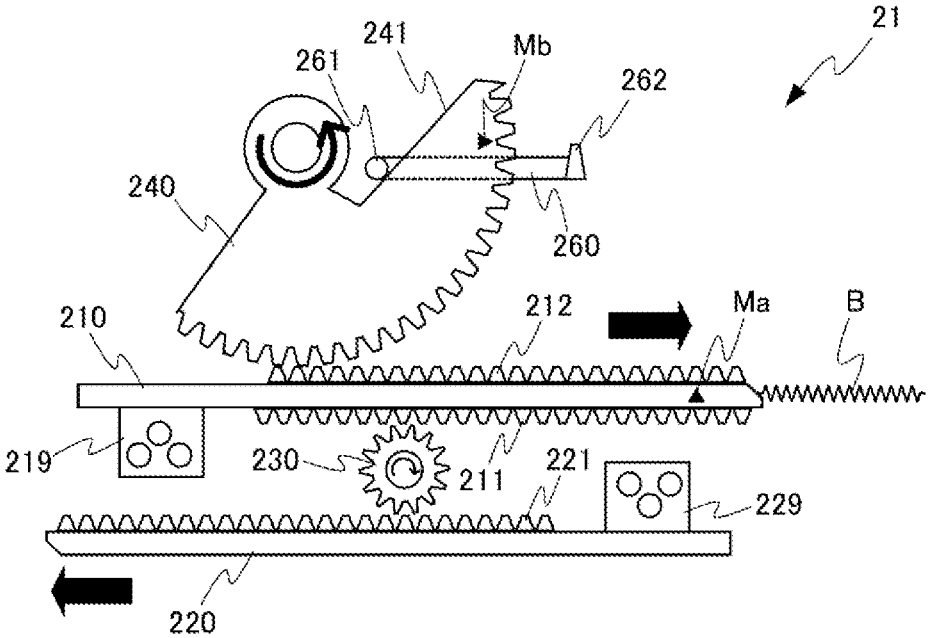
FIG. 4 is a schematic plan view illustrating an operation of the regulation device.

An operation of the regulation device according to the first embodiment will be described. FIG. 4 is a schematic plan view illustrating the operation of the regulation device.

As illustrated in FIG. 4, if the first rack gear 210 is urged inward (the right in FIG. 4) in the horizontal direction by the urging member B, the pinion gear 230 engaging with the first gear portion 211 of the first rack gear 210 is rotated clockwise in FIG. 4. At this time, the second rack gear 220 of which the first gear portion 221 engages with the pinion gear 230 is moved inward (the left in FIG. 4) in the horizontal direction.

If the first rack gear 210 is moved inward in the horizontal direction, the regulation gear 240 engaging with the second gear portion 212 of the first rack gear 210 is rotated counterclockwise in FIG. 4. If the regulation gear 240 is rotated counterclockwise, the locked surface 241 of the regulation gear 240 comes into contact with the locking portion 261 of the rotation regulation portion 260 to further regulate rotation.

If the counterclockwise rotation of the rotation regulation portion 260 is regulated, inward rotation of the first rack gear 210 of which the second gear portion 212 engages with the rotation regulation portion 260 in the horizontal direction is further regulated. If movement of the first rack gear 210 is regulated, rotation of the pinion gear 230 engaging with the first gear portion 211 of the first rack gear 210 is further regulated. If the rotation of the pinion gear 230 is regulated, inward movement of the second rack gear 220 in which the pinion gear 230 and the first gear portion 221 engage with each other in the horizontal direction is further regulated.

In this way, if the rotation regulation portion 260 regulates the rotation of the regulation gear 240, inward movement of the first rack gear 210 and the second rack gear 220 interlocking each other in the horizontal direction is regulated. If the locking portion 261 of the rotation regulation portion 260 becomes closer to the rotation shaft Ab of the regulation gear 240, a rotatable range of the rotation regulation portion 260 in the counterclockwise direction increases. Accordingly, as the locking portion 261 is closer to the rotation shaft Ab, the connection portion 219 of the first rack gear 210 is closer to the connection portion 229 of the second rack gear 220.

According to the regulation device 21 according to the present embodiment, the first rack gear 210 and the second rack gear 220 interlocking the two guide support units 30 can be regulated so as not to move inward in the horizontal direction beyond a preset position. Accordingly, the user can set the rolled sheet R in the printer 1 more easily.

A pitch circle diameter of the regulation gear 240 can be made smaller than the width of the rolled sheet R. For example, a case in which a maximum width of the rolled sheet R used in the printer 1 is set to 118 mm and movement of the two guide support units 30 within a regulation range from a minimum regulation width of 25 mm to a maximum regulation width of 105 mm is regulated by the regulation device 21 will be assumed. In this case, a movement distance of the rotation regulation portion 260 is 40 mm by an expression of 105/2−25/2, and thus the pitch circle diameter of the regulation gear 240 can be set to about 100 mm.

In FIGS. 3 and 4, the locked surface 241 is formed in a planar shape. As will be described below, the locked surface 241 may be formed by a plurality of planes or may be formed in a curved surface shape. For example, the locked surface 241 that has an inclination eliminating a contact angle with the locking portion 261 may be formed toward a diameter outside so that the locked surface 241 is parallel to the radial direction of the pitch circle of the regulation gear 240 at a location coming into contact with the locking portion 261 located at a minimum width position and a force oriented in the movement direction of the rotation regulation portion 260 is not applied.

Second Embodiment

Figure 5:
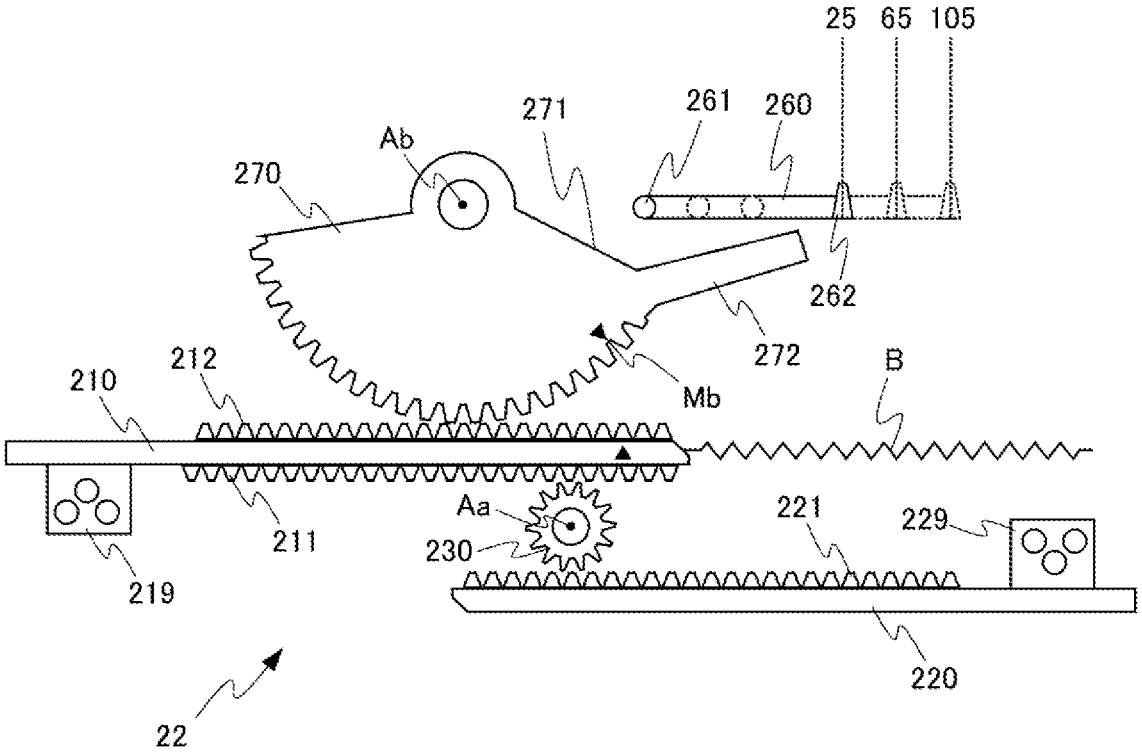
FIG. 5 is a schematic plan view illustrating a configuration of a regulation device according to a second embodiment.
Figure 6:
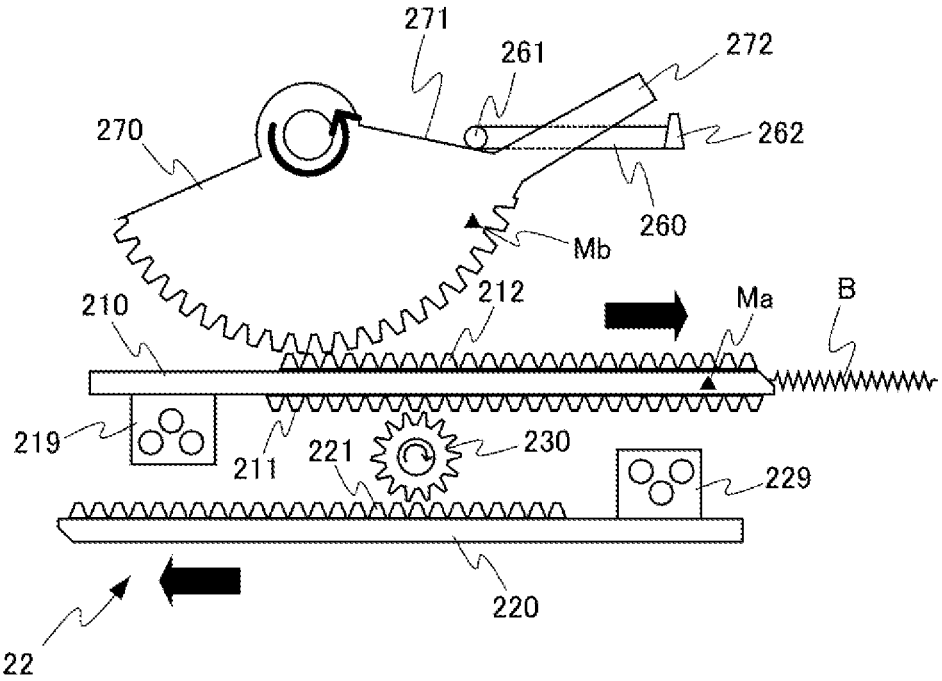
FIG. 6 is a schematic plan view illustrating an operation of the regulation device.

A configuration and an operation of a regulation device according to a second embodiment will be described. FIGS. 5 and 6 are schematic plan views illustrating the configuration and the operation of the regulation device according to the present embodiment.

As illustrated in FIG. 5, a regulation device 22 according to the present embodiment is different from the regulation device 21 according to the first embodiment in that a regulation gear 270 is included in place of the regulation gear 240. The regulation gear 270 is different from the regulation gear 240 in that a protrusion portion 272 protruding to a diameter outside of the pitch circle is further formed and a locked surface 271 is formed in place of the locked surface 241.

The protrusion portion 272 protrudes in a direction inclined by a predetermined angle to a counterclockwise side with respect to the radial direction from the vicinity of an edge on the counterclockwise side in FIG. 5 of two edges of the regulation gear 270 formed in a substantial fan shape. The locked surface 271 is formed from the protrusion portion 272 to the edge in which the protrusion portion 272 is formed.

In this way, by extending the locked surface 271 to the diameter outside of the pitch circle of the regulation gear 270, it is possible to decrease the pitch circle diameter of the regulation gear 270 while guaranteeing a distance in the radial direction of the locked surface 271 in accordance with the movement range of the rotation regulation portion 260. By decreasing the pitch circle diameter of the regulation gear 270, it is possible to achieve miniaturization of the regulation device 22 and further miniaturization of the entire printer 1.

The locked surface 271 has a plane formed in an edge and a plane formed in the protrusion portion 272, and the two planes are connected to form an angle less than 180°. Accordingly, it is possible to reduce a load on the locking portion 261 in a movement direction of the rotation regulation portion 260 and further, the latch mechanism can regulate the movement of the rotation regulation portion 260 more reliably.

As illustrated in FIG. 6, in the present embodiment, the locking portion 261 of the rotation regulation portion 260 comes into contact with the plane formed at the edge of the locked surface 271 if the locking portion 261 is located at a position corresponding to a minimum width of 25 mm of the rolled sheet R. The locking portion 261 comes into contact with the plane formed in the protrusion portion 272 if the locking portion 261 is located at a position corresponding to a width of the rolled sheet R greater than the minimum width.

Third Embodiment

Figure 7:
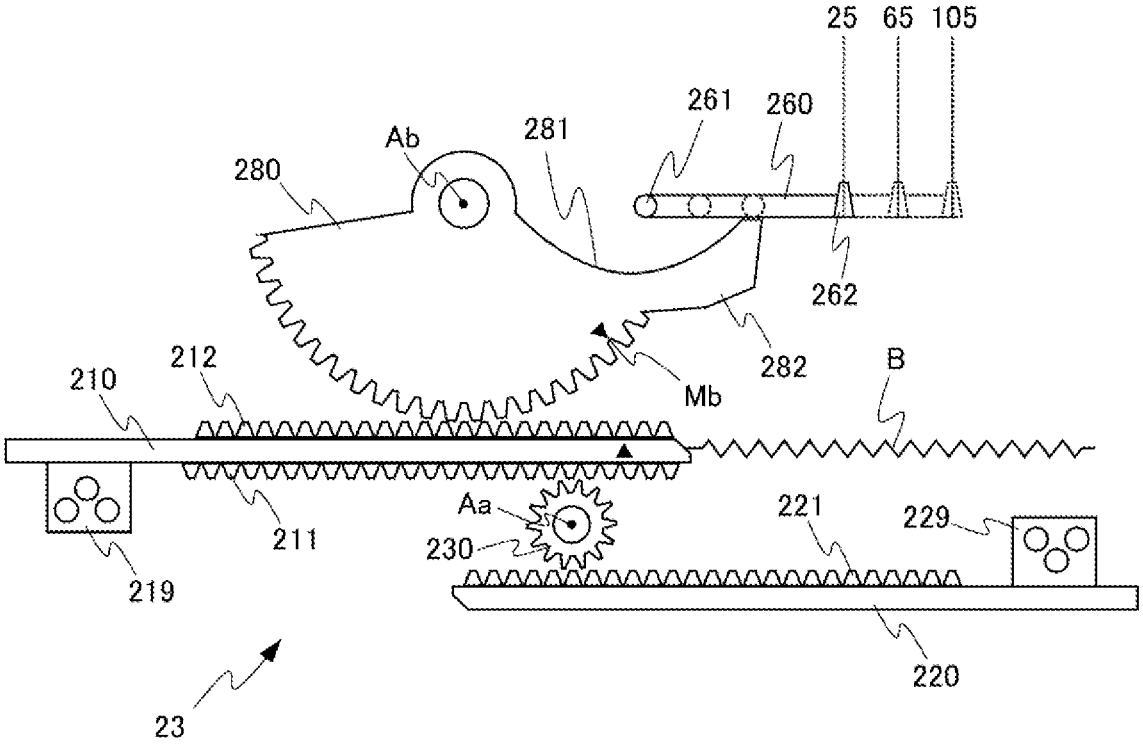
FIG. 7 is a schematic plan view illustrating a configuration of a regulation device according to a third embodiment.
Figure 8:
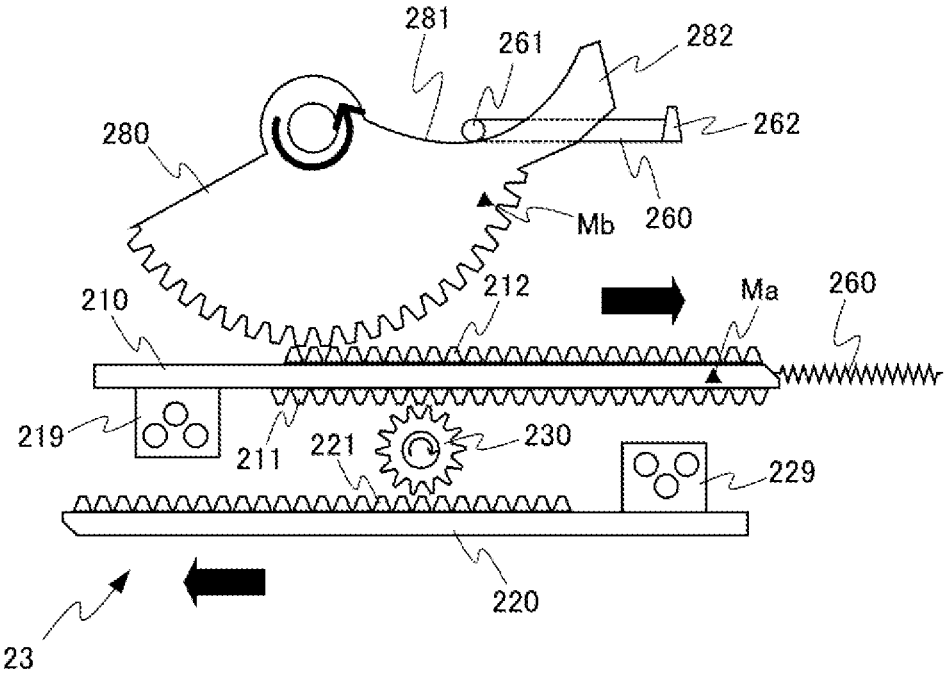
FIG. 8 is a schematic plan view illustrating an operation of the regulation device.

A configuration and an operation of a regulation device according to a third embodiment will be described. FIGS. 7 and 8 are schematic plan views illustrating the configuration and the operation of the regulation device according to the present embodiment.

As illustrated in FIG. 7, a regulation device 23 according to the present embodiment is different from the regulation device 21 according to the first embodiment in that a regulation gear 280 is included in place of the regulation gear 240. The regulation gear 280 is different from the regulation gear 240 in that a protrusion portion 282 protruding to the diameter outside of the pitch circle is further formed and a locked surface 281 is formed in place of the locked surface 241.

The protrusion portion 282 is formed to protrude from the vicinity of an edge on the counterclockwise side in FIG. 7 of two edges of the regulation gear 280 formed in a substantial fan shape. The locked surface 281 is formed from the protrusion portion 282 to the edge in which the protrusion portion 282 is formed.

The locking portion 261 is formed so that distances from all contact surfaces coming into contact with the locked surface 281 to a predetermined single point are uniform. In the present embodiment, the locking portion 261 extends along a central axis oriented in the axial direction of the rotation shaft Ab and is formed in a cylindrical shape in which a cross-sectional shape when viewed from a central axial direction is a perfect circle. The locked surface 281 is formed in a curved surface shape along a curved line in which an Archimedes' screw is offset according to a radius of the locking portion 261. Here, the Archimedes' screw is a screw in which a radius of the pitch circle of the regulation gear 280 and displacement of a rotation angle are consistent and is a curved line expressed by a polar equation of $r=a\theta$ (where, $a>\theta$ and $\theta\geq 0$).

In this way, by forming the locked surface 281 in a curved surface shape along the Archimedes' screw, a relationship between a movement amount of the rotation regulation portion 260 and regulation positions of the two guide support units 30 can be met in accordance with a sensation of the user.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A regulation device that regulates movement in a width direction of a rolled sheet of a printer, comprising:

a first rack gear connected to one guide support supporting the rolled sheet so that movement to a first side of the width direction is regulated, the first rack gear movable in the width direction;

a second rack gear connected to another guide support supporting the rolled sheet so that movement to a second side of the width direction is regulated, the second rack gear movable in the width direction;

a pinion gear engaging with the first and second rack gears; and a regulation gear configured to rotate, the regulation gear engages with and moves the first rack gear and regulates the movement of the first and second rack gears by regulating rotation of the regulation gear.

2. The regulation device according to claim 1, further comprising:

a rotation regulation portion including a locking portion that locks the regulation gear and regulates the rotation of the regulation gear, wherein the locking portion is movable in a radial direction of a pitch circle of the regulation gear.

3. The regulation device according to claim 2, wherein, in the regulation gear, a locked surface with which the locking portion comes into contact and is formed so that the regulation gear is lockable.

4. The regulation device according to claim 3, wherein the locked surface is formed by a plurality of planes or is formed in a curved surface shape.

5. The regulation device according to claim 4, wherein the locked surface is formed in a curved surface shape along an Archimedes' screw.

6. The regulation device according to claim 5, wherein, in the locking portion, at least a surface that comes into contact with the locked surface is formed in an arc shape forming a part of a perfect circle when viewed from a central axial direction of the regulation gear, and the locked surface is formed along a curved line forming the Archimedes' screw offset by a radius distance of an arc-shaped portion of the locking portion.

7. The regulation device according to claim 3, wherein the regulation gear has a substantial fan shape in which a plurality of teeth are positioned in an arc portion when viewed from a central axial direction of the regulation gear, and the locked surface is formed in one of two edges oriented in a circumferential direction in the regulation gear.

8. The regulation device according to claim 7, wherein the regulation gear includes a protrusion portion protruding to a diameter outside of a pitch circle of the regulation gear, and the locked surface is formed from one of the two edges to the protrusion portion.

9. The regulation device according to claim 1, further comprising:

an urging member that urges the first rack gear to the second side in the width direction.

10. The regulation device according to claim 1, wherein the pinion gear has a circular gear rotating about a rotation shaft and engages with a first gear portion of the first rack gear and a first gear portion of the second rack gear.

11. A printer, comprising:

a print head; and a regulation device that regulates movement in a width direction of a rolled sheet, the regulation device comprising:

a first rack gear connected to one guide support supporting the rolled sheet so that movement to a first side of the width direction is regulated, the first rack gear movable in the width direction;

a second rack gear connected to another guide support supporting the rolled sheet so that movement to a second side of the width direction is regulated, the second rack gear movable in the width direction;

a pinion gear engaging with the first and second rack gears; and a regulation gear configured to rotate, the regulation gear engages with and moves the first rack gear and regulates the movement of the first and second rack gears by regulating rotation of the regulation gear.

12. The printer according to claim 11, further comprising:

a rotation regulation portion including a locking portion that locks the regulation gear and regulates the rotation of the regulation gear, wherein the locking portion is movable in a radial direction of a pitch circle of the regulation gear.

13. The printer according to claim 12, wherein, in the regulation gear, a locked surface with which the locking portion comes into contact and is formed so that the regulation gear is lockable.

14. The printer according to claim 13, wherein the locked surface is formed by a plurality of planes or is formed in a curved surface shape.

15. The printer according to claim 14, wherein the locked surface is formed in a curved surface shape along an Archimedes' screw.

16. The printer according to claim 15, wherein, in the locking portion, at least a surface that comes into contact with the locked surface is formed in an arc shape forming a part of a perfect circle when viewed from a central axial direction of the regulation gear, and the locked surface is formed along a curved line forming the Archimedes' screw offset by a radius distance of an arc-shaped portion of the locking portion.

17. The printer according to claim 13, wherein the regulation gear has a substantial fan shape in which a plurality of teeth are positioned in an arc portion when viewed from a central axial direction of the regulation gear, and the locked surface is formed in one of two edges oriented in a circumferential direction in the regulation gear.

18. The printer according to claim 17, wherein the regulation gear includes a protrusion portion protruding to a diameter outside of a pitch circle of the regulation gear, and the locked surface is formed from one of the two edges to the protrusion portion.

19. The printer according to claim 11, further comprising:

an urging member that urges the first rack gear to the second side in the width direction.

20. The printer according to claim 11, wherein the pinion gear has a circular gear rotating about a rotation shaft and engages with a first gear portion of the first rack gear and a first gear portion of the second rack gear.

* * * * *